US005811932A

United States Patent [19]

Colditz et al.

[11] Patent Number: 5,811,932

[45] Date of Patent: Sep. 22, 1998

[54] X-RAY DETECTOR HAVING AN ENTRANCE SECTION INCLUDING A LOW ENERGY X-RAY FILTER PRECEDING A CONVERSION LAYER

[75] Inventors: Johannes K. E. Colditz; Pieter J. 't Hoen, both of Heerlen, Netherlands

[73] Assignee: U.S. Philips Corporation, New York, N.Y.

[21] Appl. No.: 673,830

[22] Filed: Jun. 27, 1996

[30] Foreign Application Priority Data

Jun. 27, 1995 [EP] European Pat. Off. ..... 95201739

[51] Int. Cl.[6] ..... H01J 40/00; H01J 31/50

[52] U.S. Cl. ..... 313/524; 250/211 VT; 313/542

[58] Field of Search ..... 313/371, 524, 313/525, 526, 541–544, 530; 250/214 VT, 207, 486.1, 487.1, 483.1

[56] References Cited

U.S. PATENT DOCUMENTS 4,725,724 2/1988 Van Der Velden ..... 313/542

4,820,926 4/1989 Popma et al. ..... 250/486.1

5,315,103 5/1994 Raverdy et al. ..... 250/214 VT 5,367,155 11/1994 Colditz et al. ..... 250/214 VT

FOREIGN PATENT DOCUMENTS

0536830A1 4/1993 European Pat. Off. ..... H01J 29/38

*Primary Examiner*—Sandra L. O'Shea

*Assistant Examiner*—Jay M. Patidar

*Attorney, Agent, or Firm*—Jack D. Slobod

[57] ABSTRACT

An X-ray image intensifier tube (1) includes an entrance section (2) for converting high-energy X-rays of from 100 keV to 120 keV into an electron beam (10). The entrance section (2) had a conversion layer (3) with a filter layer (5) for absorbing a part of comparatively low energy (from 60 keV to 80 keV) of the X-rays and a conversion layer for converting the high-energy X-rays of approximately from 100 keV to 120 keV into radiation whereto the photocathode is sensitive.

6 Claims, 2 Drawing Sheets

X-RAY DETECTOR HAVING AN ENTRANCE SECTION INCLUDING A LOW ENERGY X-RAY FILTER PRECEDING A CONVERSION LAYER

BACKGROUND OF THE INVENTION

1. Field of the Invention

The invention relates to an X-ray detector including a conversion layer for converting incident X-rays into low energy radiation. The invention notably relates to an X-ray image intensifier tube including an entrance section for converting an X-ray beam into an electron beam, and comprising a photocathode and a conversion layer for converting incident X-rays into low-energy radiation whereto the photocathode is sensitive.

2. Description of the Related Art

An X-ray detector of this kind is known from European Patent Application EP 0 536 830, which corresponds to U.S. Pat. No. 5,367,155.

The known X-ray detector is an X-ray image intensifier tube which is preferably used in an X-ray examination apparatus. An X-ray image of an object is formed by irradiating the object, for example a patient to be radiologically examined, by means of an X-ray beam emitted by an X-ray source. The X-ray image intensifier tube derives an optical image from the X-ray image; this optical image can be converted into an electronic image signal by means of an image pick-up apparatus. Viewed in the direction of incidence of the X-rays, the entrance section successively comprises a substrate, the conversion layer and the photocathode. X-rays incident on the entrance section are converted into low-energy radiation in the conversion layer, for example into blue light or ultraviolet radiation. The low-energy radiation releases a beam of electrons from the photocathode. An electron-optical system images the photocathode on a phosphor layer on an exit window. Electrons incident on the phosphor layer produce an optical image on the exit window. The optical image can be formed by means of visible light, but also by means of infrared or ultraviolet radiation.

The entrance section of the known X-ray image intensifier also comprises, arranged between the substrate and the conversion layer of sodium-doped cesium iodide (CsI:Na), a calcium tungstate layer which has a high absorptivity for low-energetic X-rays, the so-called K-radiation, generated in the conversion layer by incident X-rays. The calcium tungstate layer converts the K-radiation into blue light or ultraviolet radiation whereto the photocathode is sensitive. As a result, incident X-rays which are converted into K-radiation of approximately 35 keV in the CsI:Na conversion layer are not lost to imaging.

When an X-ray image is made of a patient by irradiation in a direction such that the X-rays travel a long way through the patient and/or when the patient is rather voluminous, often the problem is encountered that the X-ray intensity reaching the X-ray image intensifier tube is insufficient for the formation of an X-ray image having an adequate signal-to-noise ratio. This problem is encountered notably in the case of a cardiovascular radiological examination of a corpulent patient utilizing X-rays having a mean energy density of from 60 to 80 keV. The X-ray intensity reaching the X-ray image intensifier tube is increased by increasing the mean energy of the X-rays to, for example from 100 to 120 keV. If the mean energy of the X-rays, or briefly speaking the mean X-ray energy of the incident X-rays, is increased, for example from a value of from 60 keV to 100 keV to a value of from 100 keV to 120 keV as stated before, the intensity of the optical image increases until the mean X-ray energy reaches a limit value. It has been found that if the energy of the X-rays is then increased further, the intensity of the optical image decreases again. In an X-ray examination apparatus comprising a conventional X-ray image intensifier this phenomenon occurs for an X-ray energy beyond 100 keV, i.e. the limit value is approximately 100 keV. When the intensity of the optical image is too low because of excessive X-ray absorption within the patient, the radiologist will tend to increase the X-ray energy beyond the limit value; however, this has the adverse effect that the intensity of the optical image is reduced even further. Therefore, in the described circumstances the known X-ray image intensifier tube cannot contribute to the extraction of an electronic image signal having a high signal-to-noise ratio from the X-ray image.

SUMMARY OF THE INVENTION

It is an object of the invention to provide an X-ray detector, such as an X-ray image intensifier tube which has a higher limit value for the X-ray energy than the known X-ray detector.

In order to achieve this object, an X-ray detector in accordance with the invention is characterized in that it comprises an X-ray filter for shielding the conversion layer from X-rays of an energy below a threshold value.

The conversion layer converts X-rays into radiation of a wavelength which is longer than that of the incident X-rays, i.e. into radiation of an energy which is less than that of the incident X-rays. In the context of the present invention such radiation by the conversion layer is referred to as low-energy radiation. The X-ray detector comprises, for example a sensor matrix which includes a plurality of photosensitive elements. Said photosensitive elements convert the low-energy radiation into electric charges. The electric charges are read so as to form an electronic image signal on the basis thereof. The X-ray detector may also be an X-ray image intensifier tube which comprises an entrance section which includes the conversion layer and a photocathode. From the X-rays the conversion layer derives low-energy radiation whereto the photocathode is sensitive. The low-energy radiation produces an electron beam from the photocathode, which beam is imaged, by way of an electron-optical system, on a phosphor layer provided on an exit window. In the phosphor layer the electron beam generates a light-optical image which is picked up by a television camera.

The X-ray filter absorbs X-rays of an energy below the threshold value of approximately 100 keV, but does not convert these rays into low energy radiation whereby electrons are released from the photocathode. X-rays having an energy higher than the threshold value mainly pass through the X-ray filter and reach the conversion layer in which they are converted mainly into low-energy radiation.

If the X-ray detector is an X-ray image intensifier tube, the low-energy radiation is, for example blue light or ultraviolet radiation whereto the photocathode is sensitive. If the X-ray detector comprises a sensor matrix, the low-energy radiation is, for example green light whereto the photosensitive elements are sensitive.

Because the energy spectrum of the X-rays reaching the conversion layer contains at the most a very slight intensity of X-rays having an energy below the threshold value, the intensity of the optical image increases when the highest energy in the energy spectrum is increased to an energy range beyond the threshold value. Absorption by the conversion layer of low-energy radiation generated from X-rays in the conversion layer is dominated to an increasing extent by the increasing penetration depth of X-rays in the conversion layer in the energy range of the X-rays of energy beyond the threshold value, so that the yield of low-energy radiation increases. This means that the limit value will be higher as the energy spectrum of the X-rays reaching the conversion layer contains fewer components of low energy. Because the quantity of low-energy radiation increases, the intensities of the electron beam and of the optical image on the exit window also increase as a function of the mean X-ray energy.

Scattered radiation occurring in the object, for example due to Compton scattering of electrons in the object, has a comparatively low energy and is intercepted to a substantial degree by the X-ray filter; as a result, the X-ray detector tube in accordance with the invention is less sensitive to scattered radiation. The X-ray filter thus counteracts blurring of the optical image by scattered radiation.

Upon use of X-rays of an energy below the threshold value, the absorption of energy in the X-ray filter causes a reduction of the conversion efficiency of the X-ray detector the reduced conversion efficiency is compensated for by increasing the intensity of the X-ray beam, for example by increasing the anode current in the X-ray source and/or by increasing the amount of light picked up by the image pick-up apparatus by increasing the aperture of a diaphragm of the image pick-up apparatus picking up the optical image. The reduction of the conversion efficiency can also be compensated for by increasing the amplification of the image signal supplied by the image pick-up apparatus. The effectiveness of the X-ray detector in accordance with the invention for X-rays of comparatively low energy is thus maintained.

An X-ray image intensifier tube in accordance with the invention is characterized in that the entrance section comprises a filter layer for shielding the conversion layer from X-rays of an energy below a threshold value, and that the conversion layer is situated between the photocathode and the filter layer.

In relation to the conversion layer the filter layer acts as an X-ray filter having a high energy transmission curve.

A preferred embodiment of an X-ray image intensifier tube in accordance with the invention is characterized in that the filter layer consists of a thin, non-doped CsI layer having a thickness of between 30 $\mu$m and 100 $\mu$m.

X-rays having an energy of from approximately 100 keV to 200 keV are hardly absorbed by the filter layer having such a composition, but are converted mainly into low-energy radiation in the conversion layer. The thickness of the filter layer should be more than 30 $\mu$m, because otherwise hardly any absorption occurs. The filter layer should not be thicker than 100 $\mu$m, because the use of X-rays having a comparatively low energy would otherwise necessitate the anode current of the X-ray source to be increased to unrealistically high values so as to form an optical image of sufficient brightness on the exit window. The best results are obtained when the filter layer has a thickness of between 50 $\mu$m and 100 $\mu$m.

A further preferred embodiment of an X-ray image intensifier tube in accordance with the invention is characterized in that the entrance section comprises a reflection layer which is provided between the conversion layer and the filter layer and is reflective for radiation generated in the conversion layer by absorption of X-rays.

The reflection layer reflects radiation generated in the conversion layer by incident X-rays. Radiation whereto the photocathode is sensitive but which is emitted in the direction away from the photocathode, therefore, will not be lost but reflected to the photocathode by the reflection layer. Consequently, a larger part of the radiation generated in the conversion layer is available for conversion into electrons in the photocathode, so that the sensitivity of the X-ray image intensifier tube to incident X-rays is enhanced. This offers the advantage that the X-ray dose whereto the patient must be exposed so as to form an X-ray image of adequate diagnostic quality is thus reduced. The use of a reflection layer between the filter layer and the conversion layer enables the use of a doped cesium iodide layer for the filter layer; preferably, the same material as that used for the conversion layer is then used. Blue light or ultraviolet radiation generated in the filter layer is mainly reflected by the reflection layer and cannot reach the photocathode. As a result, the photocathode is reached mainly by low-energy radiation generated in the conversion layer by a high-energetic component of the incident X-rays.

A further preferred embodiment of an X-ray image intensifier tube in accordance with the invention is characterized in that the reflection layer is a thin aluminium layer which is substantially totally reflective for the radiation generated in the conversion layer by absorption of X-rays.

An aluminium layer is suitable for deposition as a continuous metallic layer on the scintillation material of the filter layer. Moreover, a metallic aluminium layer is a suitable reflector for the low-energy radiation which is generated in the conversion layer by the incident X-rays and whereto the photocathode is sensitive.

A further preferred embodiment of an X-ray image intensifier tube in accordance with the invention is characterized in that the conversion layer and the filter layer are doped cesium iodide layers.

This embodiment can be simply and hence inexpensively manufactured, because the same material composition is used for the filter layer and the conversion layer.

These and other aspects of the invention will be apparent from and elucidated with reference to the embodiments described hereinafter.

DETAILED DESCRIPTION OF THE PREFERRED EMBODIMENT

Figure 1:
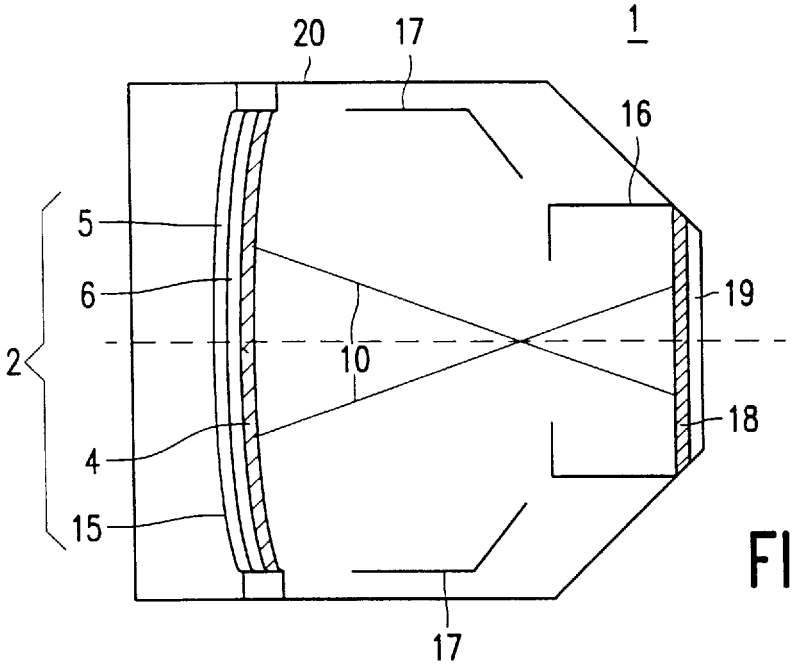
FIG. 1 is a diagrammatic representation of an X-ray image intensifier tube in accordance with the invention.

FIG. 1 is diagrammatic representation of an X-ray image intensifier tube 1 in accordance with the invention. In a vacuum envelope 20 there are accommodated an entrance section 2, an electron optical system (4, 16, 17, 18), and a phosphor layer 18. The entrance section 2 comprises a conversion layer 6 which is provided, together with a filter layer 5, on a substrate 15, for example an aluminium foil. The filter layer 5 is then situated between the substrate 15 and the conversion layer 6. On the side of the conversion layer 6 which is remote from the substrate 15 there is provided a photocathode 4. The conversion layer 6 converts X-rays incident on the entrance section into radiation whereto the photocathode is sensitive, for example blue light or ultraviolet radiation. An electron-optical system, comprising the photocathode 4, a hollow anode 16 and electrodes 17, electron-optically images the photocathode 4 on a phosphor layer 18 which is provided on an exit window 19. The electron beam incident on the phosphor layer 18 generates an optical image, for example in green light, which can be picked up from the exit window by means of an image pick-up apparatus, for example a video camera.

Figure 2:
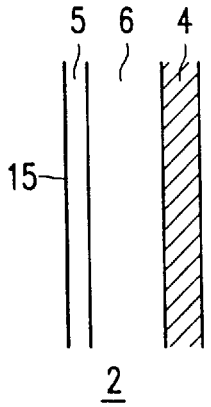
FIG. 2 is a diagrammatic representation of a detail of an entrance section of an embodiment of the X-ray image intensifier tube shown in FIG. 1.

FIG. 2 is a diagrammatic representation of a detail of an entrance section of an embodiment of the X-ray image intensifier tube shown in FIG. 1. On the substrate 15 there are successively provided the filter layer 5 of a non-doped scintillation material, for example a layer of cesium iodide (CsI) which is thicker than 30 $\mu$m and preferably has a thickness of between 50 $\mu$m and 100 $\mu$m, on which there is provided the conversion layer 6 of a doped scintillation material, for example sodium-doped cesium iodide (Csi:Na) of a thickness of between 300 $\mu$m and 1000 $\mu$m. On the conversion layer 6 there is provided the photocathode 4 which contains, for example antimony saturated with alkali metal. The non-doped CsI in the filter layer 5 absorbs mainly the incident X-rays of comparatively low energy, i.e. between 60 keV and 80 keV, so below the threshold value of approximately 100 keV. X-rays of higher energy, beyond the threshold value, for example 100 keV to 120 keV, reach the CsI:Na conversion layer 6. The conversion layer 6 converts the X-rays of higher energy mainly into low-energy radiation such as blue light or ultraviolet radiation whereto the photocathode is sensitive. Because X-rays having an energy below the threshold value are absorbed in the filter layer 5 and do not generate low-energy radiation, the limit value is increased so that the mean X-ray energy remains below the limit value in the energy range between approximately 100 keV and 120 keV. In this energy range the penetration depth of the X-rays increases as the energy of the X-rays increases and the amount of low-energy radiation generated increases more than the absorption of the secondary radiation in the conversion layer 6. As a result, in an X-ray image intensifier tube in accordance with the invention the intensity of the optical image increases when the X-ray energy is increased in the energy range from 100 keV to 120 keV .

Figure 3:
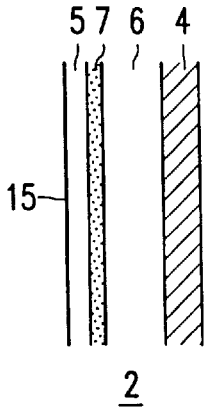
FIG. 3 is a diagrammatic representation of a detail of an entrance section of a further embodiment of the X-ray image intensifier tube shown in FIG. 1.

FIG. 3 is a diagrammatic representation of a detail of an entrance section of a further embodiment of the X-ray image intensifier tube shown in FIG. 1. In the entrance section 2 shown in FIG. 3 an aluminium reflection layer 7 is provided between the conversion layer 6 and the filter layer 5. This reflection layer reflects the blue light or the ultraviolet radiation generated by the X-rays incident on the conversion layer 6. As a result, at least a part of the blue light or the ultraviolet radiation generated in the conversion layer but not emitted towards the photocathode is not lost but remains available so as to release electrons in the photocathode. Therefore, the reflection layer increases the sensitivity of the X-ray image intensifier tube. In the embodiment shown in FIG. 3 the filter layer is preferably constructed as a doped cesium iodide layer. Blue light and/or ultraviolet radiation generated in such a filter layer is reflected by the reflection layer so that it cannot reach the photocathode.

Figure 4:
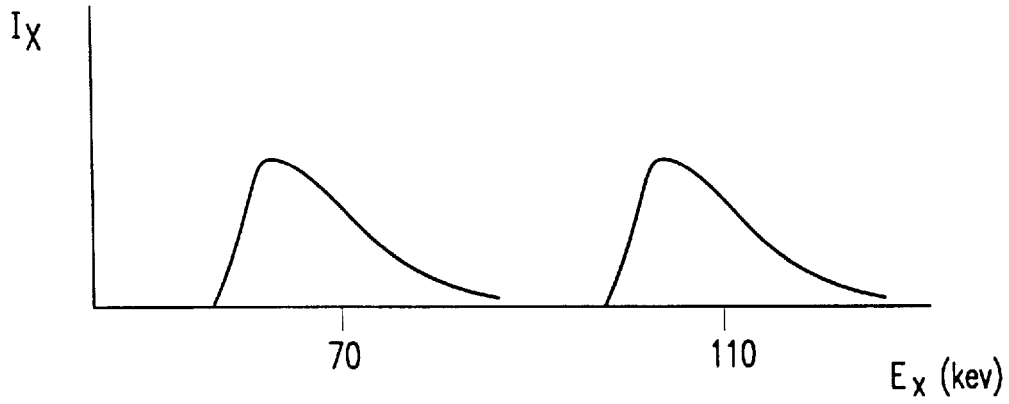
FIG. 4 shows a simplified example of an energy spectrum of X-rays incident on the entrance screen.

The advantageous effect of the filter layer 5 as a high-pass energy filter will be described on the basis of a strongly simplified example. FIG. 4 shows, by way of example, ann energy spectrum of X-rays with a low-energy component of energy in an energy band around a mean value $<E_1>$ of approximately 70 keV and with a high-energy component of energy in an energy band around a mean value $<E_h>$ of approximately 110 keV. The energy spectrum is represented as the radiation intensity $I_x$ as a function of the X-ray energy $E_x$.

Figure 5:
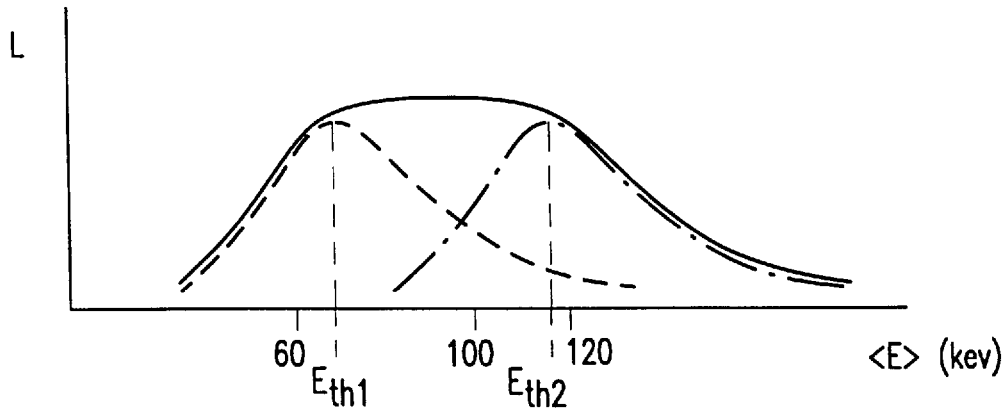
FIG. 5 shows a simplified example of the intensity of the low-energy radiation which is generated by the absorption of X-rays in a layer of scintillation material and is emitted thereby.

FIG. 5 shows a simplified example of the intensity of the low-energy radiation which is generated by the absorption of X-rays in a layer of a scintillation material and is emitted thereby. The dashed curve represents, as a function of the mean X-ray energy $<E>$, the intensity of the low-energy radiation which is generated by the low-energy component of the X-rays and is emitted by the layer of scintillation material. In the case of a low X-ray energy, the penetration depth of the X-rays is small and only a small amount of X-rays is absorbed so as to generate low-energy radiation. The low-energy radiation is then generated mainly in a thin layer at the surface on the side where the X-rays are incident; a major part thereof is absorbed again by the scintillation material before it leaves the layer. As the X-ray energy increases, the penetration depth increases and more low-energy radiation is generated, which low-energy radiation then travels a shorter way through the scintillation material so as to leave the layer; as a result, the intensity of the low-energy radiation emitted by the layer increases as the mean X-ray energy of the low-energy component increases until a maximum is reached at $E_{th1}$. If the X-ray energy is increased further, the absorption in the scintillation material is no longer compensated by the increasing penetration depth, but the X-rays increasingly pass through the scintillation material without absorption. A further increase of the mean energy of the X-rays reduces the intensity of the low-energy radiation emitted by the layer of scintillation material. The decrease of the intensity of the low-energy radiation causes a decrease of the intensity of the optical image in an image intensifier pick-up chain when the X-ray energy is increased beyond the threshold value $E_{th1}$.

The intensity of the low-energy radiation emitted by the layer of scintillation material due to absorption of the high-energy component of the X-rays is represented by the dash-dot curve. The intensity of the low-energy radiation initially increases, because of the increasing penetration depth, until a maximum is reached at $E_{th2}$; for an even higher X-ray energy the increasing penetration depth is outweighed by the absorption of low-energy radiation in the scintillation material.

When X-rays having a high-energy and a low-energy component is incident on a layer of scintillation material, the intensity of the low-energy radiation emitted by the layer of scintillation material is dependent on the mean X-ray energy in conformity with the solid curve in FIG. 5. The solid curve represents the sum of the contributions of the high-energy and low-energy components, weighted by the intensities of the high-energy and low-energy components, in conformity with the dash-dot curves. The solid curve clearly demonstrates that the threshold value for the X-ray energy beyond which the increasing of the X-ray energy no longer causes an increased intensity of the low-energy radiation amounts to approximately $E_{th1}$. If only the high-energy component of the X-rays is incident on the scintillation material, the intensity of the emitted low-energy radiation is dependent on the mean X-ray energy in conformity with the dash-dot curve and the limit value amounts to approximately $E_{th2}$. By filtering the low-energy component out of the X-ray energy, for example by means of the filter layer, therefore, it is achieved that the limit value is increased from $E_{th1}$ (approximately 80 keV) to $E_{th2}$ (approximately 120 keV).

We claim:

1. An X-ray detector comprising a conversion layer for converting incident X-rays into low-energy radiation, and an X-ray filter for shielding the conversion layer from X-rays of an energy below a threshold value of approximately 100 keV.

2. An X-ray image intensifier tube comprising an entrance section for converting an X-ray beam into an electron beam, a photocathode, and a conversion layer for converting incident X-rays into low-energy radiation whereto the photocathode is sensitive, characterized in that the entrance section comprises a filter layer for shielding the conversion layer from X-rays of an energy below a threshold value of approximately 100 keV, and that the conversion layer is situated between the photocathode and the filter layer.

3. An X-ray image intensifier tube as claimed in claim 2, characterized in that the filter layer (5) consists of a thin, non-doped CsI layer having a thickness of between 30 $\mu$m and 100 $\mu$m.

4. An X-ray image intensifier tube as claimed in claim 2, characterized in that the entrance section comprises a reflection layer which is provided between the conversion layer and the filter layer, and is reflective for radiation generated in the conversion layer by absorption of X-rays.

5. An X-ray image intensifier tube as claimed in claim 4, characterized in that the reflection layer is a thin aluminium layer which is substantially totally reflective for the radiation generated in the conversion layer by absorption of X-rays.

6. An X-ray image intensifier tube as claimed in claim 5, characterized in that the conversion layer and the filter layer are doped cesium iodide layers.

* * * * *